US006293193B1

(12) United States Patent
Bolza-Schünemann

(10) Patent No.: US 6,293,193 B1
(45) Date of Patent: Sep. 25, 2001

(54) METHOD FOR PRINTING SHEETS

(75) Inventor: Hans-Bernhard Bolza-Schünemann, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/581,514

(22) PCT Filed: Dec. 18, 1998

(86) PCT No.: PCT/DE98/03726

§ 371 Date: Aug. 8, 2000

§ 102(e) Date: Aug. 8, 2000

(87) PCT Pub. No.: WO99/32292

PCT Pub. Date: Jul. 1, 1999

(30) Foreign Application Priority Data

Dec. 19, 1997 (DE) ..... 197 56 796

(51) Int. Cl.[7] ..... B41F 13/24; B41F 5/02

(52) U.S. Cl. ..... 101/229; 101/232; 101/177

(58) Field of Search ..... 101/232, 231, 101/237, 238, 240, 137, 229, 177, 183; 347/129, 153; 356/394

(56) References Cited

U.S. PATENT DOCUMENTS

| | | | | |
|---|---|---|---|---|
| 3,384,011 | * | 5/1968 | Bolza-Schünemann | 101/177 |
| 3,570,398 | * | 3/1971 | Mowry | 101/231 |
| 3,848,320 | * | 11/1974 | Davidson, Jr. | 101/177 |
| 4,723,137 | * | 2/1988 | Playe | 347/153 |
| 4,810,120 | * | 3/1989 | Narita | 101/296 |
| 4,970,661 | * | 11/1990 | Tsuzuki et al. | 347/129 |
| 5,009,156 | * | 4/1991 | Germann | 101/177 |
| 5,471,309 | * | 11/1995 | Bolza-Schünemann | 356/394 |
| 5,479,856 | * | 1/1996 | Wirz | 101/177 |
| 5,660,108 | * | 8/1997 | Pensaveuchia | 101/177 |
| 5,724,437 | * | 3/1998 | Bucher et al. | 101/183 |
| 5,873,309 | * | 2/1999 | Mack et al. | 101/232 |
| 6,050,188 | | 4/2000 | Bolza-Schunemann . | |
| 6,062,116 | * | 5/2000 | Bolza-Schünemann | 101/137 |

FOREIGN PATENT DOCUMENTS

| | | | |
|---|---|---|---|
| 285 878 A7 | 1/1991 | (DE) | B41F/7/00 |
| 19523378 A1 | 1/1997 | (DE) | B41F/7/02 |
| 19644950 A1 | 11/1997 | (DE) | B41F/21/00 |
| 19720072 A1 | 1/1998 | (DE) | B41M/1/14 |

* cited by examiner

*Primary Examiner*—Eugene Eickholt
(74) *Attorney, Agent, or Firm*—Jones, Tullar & Cooper, PC

(57) ABSTRACT

Sheets are printed by being automatically run twice through a printing machine. The first sides of each of the sheets are printed in one, or a plurality of colors during a first printing pass. The sheets so printed are then placed in an intermediated storage facility, which is located within the printing machine. These sheets are then rotated 180 degrees and are printed on second sides in one or a plurality of colors during a second printing pass. The sheets are then fed to a final storage device.

2 Claims, 3 Drawing Sheets

| Sheet feed to printing cylinder 4 with four fields 4.1, 4.2, 4.3, 4.4 always at clock cycle A/D gripper sequence | | Color fields first 5.1/second 5.2 rubber blanket cylinder with three fields A, B, C, or respectively D, E, F | Sheet removal from printing cylinder 4 always at clock cycle C/F |
|---|---|---|---|
| Sheet against | → 4.1 | A/D | |
| | 4.2 | B/E | |
| | 4.3 | C/F | No sheet on 4.3 (→) |
| Sheet against | → 4.4 | A/D | |
| | 4.1 | B/E | |
| Sheet against | 4.2 | C/F | No sheet on 4.2 (→) |
| Printing on | → 4.3 | A/D | |
| | 4.4 | B/E | |
| | 4.1 | C/F + (B/E) + (A/D) = 2F | → Sheet delivery (→ waste) |
| Sheet against | → 4.2 | A/D | |
| | 4.3 | B/E | |
| | 4.4 | C/F + B/E + (A/D) = 4F | → Sheet delivery (→ waste) |
| Sheet against | → 4.1 | A/D | |
| | 4.2 | B/E + A/D | |
| | 4.3 | C/F + B/E + A/D = 6F | → Sheet delivery |
| Sheet against | → 4.4 | A/D | |
| | 4.1 | B/E + A/D | |
| | 4.2 | C/F + B/E + A/D = 6F | → Sheet delivery |
| Sheet against | → 4.3 | A/D | |
| | 4.4 | B/E + A/D | |
| | 4.1 | C/F + B/E + A/D = 6F | → Sheet delivery |
| Sheet against | → 4.2 | A/D | |
| | 4.3 | B/E + A/D | |
| | 4.4 | C/F + B/E + A/D = 6F | → Sheet delivery |
| Sheet against | → 4.1 | A/B | |

Fig. 3

METHOD FOR PRINTING SHEETS

FIELD OF INVENTION

The present invention relates to methods for printing sheets in a rotary printing press. Sheets are initially printed in one or several colors on a first side. These sheets are directed to an intermediate storage device within the press. They are then again passed through the press and their second sides are printed in one or several colors.

DESCRIPTION OF PRIOR ART

It is generally known to first print the front of a sheet in the course of a first passage of the sheet through the press. Thereafter, the stacks of sheets that have been printed on one side are left waiting for several hours for the purpose of absorption and drying of the ink. A second passage through the press then takes place to accomplish this printing of the back of the page. For this purpose, each stack must first be inverted outside of the press, either manually or by means of a stack turner. Furthermore, a fresh printing forme must be provided, if different backs are to be printed for all front pages.

With large prime and perfecting printing, two sheet-fed rotary printing presses are often employed in parallel-one for prime printing and one for perfecting printing.

If the number of front pages is half, or less than the maximum width of the maximum press size, a single printing forme per color is sufficient, wherein the prime pages are arranged on one press half and next to them the perfecting pages for simultaneous printing. In the case of this "work and turn" printing, or the so-called turning, sheets printed on one side with prime and perfecting sides arranged centered in respect to the running direction are being created in the first press passage. During the second passage of previously printed and now turned pages, and the same printing forme, prime and perfecting sides are offset from each other in such a way, that two identical half-size sheets, each printed on both sides, are created as soon as the entire sheet has been cut along the center in the running direction.

Also, presses with sheet-turning attachments are used. These have, for example, downstream of four printing towers which accomplish prime printing, a special sheet-turning attachment. This device inverts each individual sheet and then guides it, with the previously rear edge now in front, through four further printing towers for perfecting, so that 4/4-printing over the full sheet size is accomplished.

DE 196 44 950 A1 describes a method for prime and perfecting printing in a sheet-fed rotary printing press, wherein a stack is pivoted over 180°.

SUMMARY OF THE INVENTION

The object of the present invention is directed to providing a method for producing printed sheets in a sheet-fed rotary printing press.

The object is attained by the provision of a sheet-fed, rotary printing press through which each sheet passes twice. On its first passage, a first side of each sheet is printed in a single or in multiple colors. The printed sheet is held in an intermediate storage area and is then turned. The second side of the sheet is then printed in one or a plurality of colors. Preferably each side of the sheet is printed with a prime print subject and a perfecting print subject using two adjacent print areas.

The advantages which can be achieved by means of the present invention primarily reside in that sheet-fed printing presses are made possible which are particularly space- and cost-saving and which are very flexible. In accordance with the present invention, these presses can be used, with maximum sheet size and with one passage of each sheet through the press for prime printing, or with two automatic passages of each sheet through the press for prime and perfecting printing in double production, for example with half-sized sheets with a single printing forme per color, i.e. with computer-to-press illustration or, for full size prime and perfecting printing, with two automatic press passages with an interposed new illustration for the different perfecting formes per color.

For example, in accordance with the method of the present invention, a four-color sheet-fed offset press can fully automatically produce either four-color printing in DIN A2 (=four pages DIN A4) printed on one side or, with double production, four-color printing in DIN A3 (=2 pages DIN A4) printed on two sides with one printing forme per ink color, or four-color printing DIN A2 (=4 pages DIN A4) printed on two sides (with a fresh plate illustration prior to the second perfecting sheet passage).

In connection with another described embodiment of the printing press, the method can fully automatically create, for example, six-color one-page printing in DIN A3 (=two pages DIN A4) with one plate illustration per color, or in six-color double-sided printing in DIN A4 or, with a second plate illustration, six-color double-sided printing in DIN A3 (=two pages DIN A4).

For this, only five cylinders are required for the printing process—without a gripper change for six-color printing per side of sheet. In comparison, a conventional 6+6 serial color press requires twelve printing cylinders, twelve rubber blanket cylinders and twelve plate cylinders and, depending on the construction, eleven or thirty-three sheet transfer drums between the printing cylinders. This conventional press needs at least twenty-three, or even forty-five critical sheet transfers, as well as an enormous space requirement. The prime and perfecting printing method, as well as the prime printing method, in accordance with the present invention, can perform six-color printing with one gripper closure per page and without sheet transfer. Novel presses in accordance with this invention can also be used in an advantageous manner for small batches and for "print on demand" work.

The presses in accordance with the present invention allow multi-color prime and perfecting printing without a sheet-turning attachment prior to the perfecting printing systems within the arrangement of the printing systems.

BRIEF DESCRIPTION OF THE DRAWINGS

Preferred embodiments for accomplishing the method in accordance with the present invention will be explained by means of the drawings.

Shown are in.

DESCRIPTION OF THE PREFERRED EMBODIMENTS

The combination in accordance with the present invention consists of, in summary;

a sheet-fed printing press with at least one printing cylinder and a printing system, wherein the sheet outlet and the sheet feeding are arranged on the same side of the printing cylinder, where the sheets to be printed lie in the feeding stack and on the feeding table with the side to be printed facing down and are turned in the printing press during the printing process in such a way that they reach the delivery stack above the sheet feeding device with the printed side facing up, an effective drying device at, or following the printing cylinder at the sheet outlet, preferably for UV drying, a cooling device for the dryer, the press and the printed sheet, as needed, a stack raising and lowering device for the sheet feeder, a stack raising and lowering device for the sheet delivery, a conveying device for stack movements from outside of the press into or out of the sheet feeder, out of the sheet delivery device into the sheet feeder, and out of the sheet delivery device to the outside of the press, a turntable for 180° rotation of the sheet delivery device around its vertical axis prior to reaching its work position in the sheet feeder for the second printing operation for perfecting printing, a longitudinal sheet cutting device for center cutting, when required, an electronic control for the fully automatic or semi-automatic operating sequence of all required process steps for a double sheet passage, including sheet turning and stack rotation for prime and perfecting printing by means of a single combined prime and perfecting printing forme per color for twice half the sheet width, an electronic control for the fully automatic or semi-automatic operating sequence of all required process steps for a single sheet passage without stack rotation, for prime printing, with respectively one single prime printing forme per color for the entire sheet width, an electronic control for the fully automatic or semi-automatic operating sequence of all required process steps for a double sheet passage, including sheet turning and stack rotation for prime and perfecting printing, wherein following the termination of the prime printing with full sheet width, including sheet turning and stack rotation, a fresh illustrated perfecting printing forme per color is clamped or automatically illustrated in the press prior to the start of the perfecting print passage.

Figure 1:
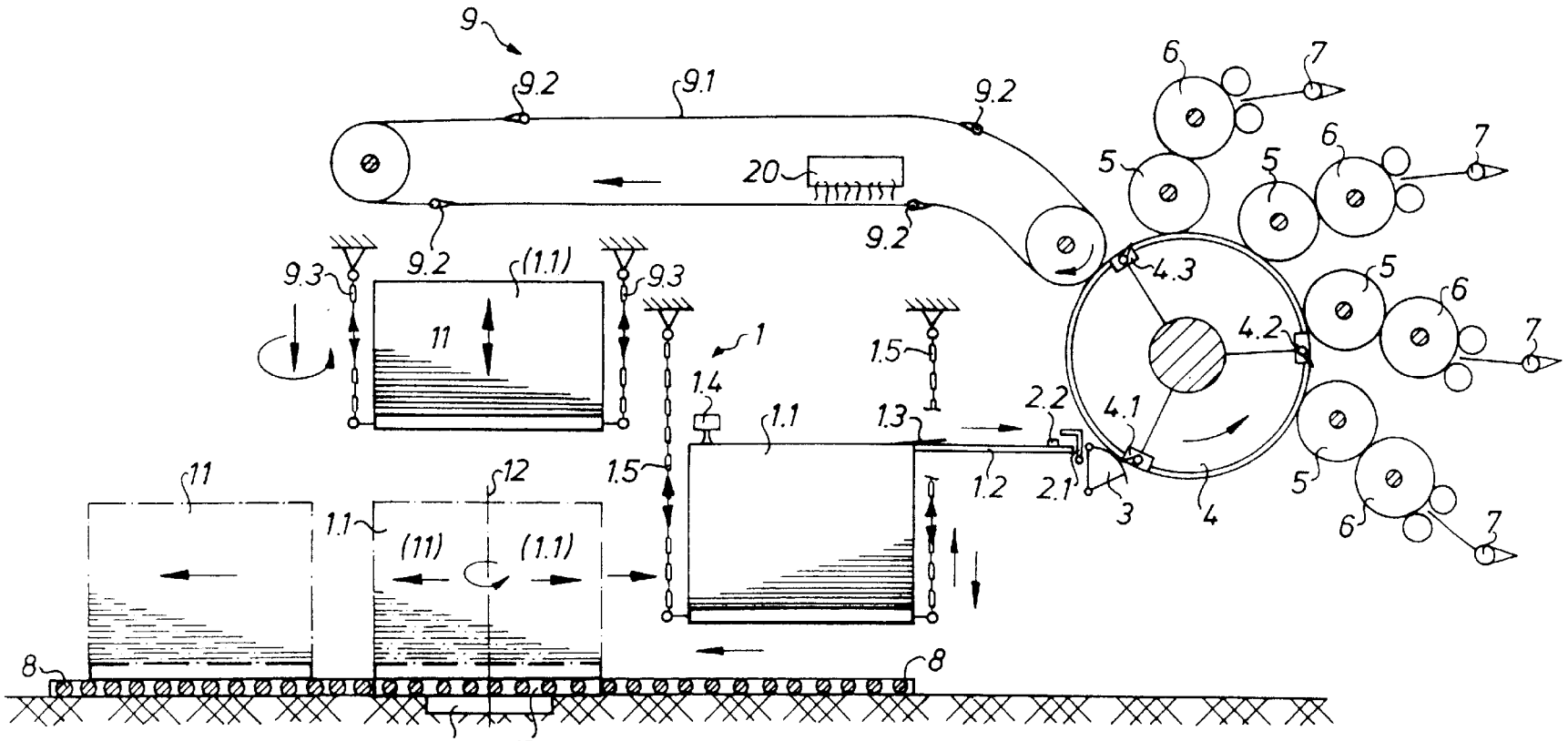
FIG. 1, a schematic representation of a four-color sheet-fed rotary printing press for prime and perfecting printing, or the only prime printing, FIG. 2, a schematic representation of a six-color sheet-fed rotary printing press for prime and perfecting printing, or only for prime printing, and in FIG. 3, a sheet sequence of the press in accordance with FIG. 2.

FIG. 1 shows a four-color sheet-fed rotary printing press In accordance with the present invention. This press is for prime and perfecting printing, or for only prime printing, of a special construction, because the sheet feeder is not arranged on the right outside, the printing systems not in the center, and the delivery stack not on the left. Instead, the sheet feeder 1 with its raising and lowering device 1.5 for the feeder stack 1.1, feed table 1.2 and a sheet feeder 3—in the form of a swinging gripper —is located next to the printing systems. For example this sheet feeder is located on the left of the printing system and is on the side of a delivery device 9 and below the delivery chain 9.1 of the latter. The front lay marks are identified by 2.1 and the lateral pull-type lay marks are identified by 2.2.

A printing and sheet feeding cylinder 4 rotates counter-clockwise and supports three controlled gripper systems 4.1 to 4.3. A plurality of printing units for example four such printing units, rubber blanket cylinders 5, plate cylinders 6 and ink ducts 7 for multi-color wet-in-wet printing are assigned to this printing cylinder 4. Each gripper system 4.1 to 4.3 of the printing cylinder 4 passes a sheet, with four colors printed on one side and with the printed side facing up, to a selected gripper system 9.2 of a plurality of gripper systems 9.2 of a delivery chain 9.1. The gripper systems 9.1, 9.2 open in a clocked or timed manner in order to deposit sheets, which have been printed on one side in prime printing, on an intermediate stack 1.1 of a delivery stack device 9.3, which is generally known and which has a raising and lowering device. If the sheets have now been are printed on both sides—i.e. in prime and perfecting printing—they are placed on the same device, but now so-called "end stack 11" is formed. The latter is moved out of the press in the end.

A dryer, for example a UV dryer 20, is located in the delivery device 9 inside of the conveying track of the printed sheets, so that only sheets with hardened, or at least sufficiently pre-dried ink reach the sheet and intermediate storage device in the form of an intermediate stack 1.1.

At a preprogrammed number of printed sheets, or when the delivery stack 11 is full (full end storage device), printing is automatically shut off, the ink is turned off and the press is shut down. The end stack 11, or respectively the intermediate stack 1.1, is than automatically lowered. If the stack is a full end stack 11, it is moved toward the left out of the press and away from the full or empty intermediate stack 1.1 by means of a linear conveying device 8.

It is, of course, necessary to first create an intermediate stack 1.1. In order to create it, in place of the stack 1.1 with its sheets which have already been printed on one side by the press, first a "prime stack" with unprinted sheets must be brought automatically or manually to the feeder 1. Its sheets are then fed to the press and printed on one side. Subsequently they are deposited by the delivery device 9 on a stack, i.e. the feed stack 1.1 as functioning the intermediate storage device. This discussion also applies in connection with the second preferred embodiment which will be discussed shortly.

Thereafter, the intermediate stack 1.1 is lowered until it rests on a turntable 13. Then the intermediate stack 1.1 is automatically rotated by 180° in a plane defined by its respective sheets, so that the initial leading and of the respective sheets again points in the paper running direction toward the printing cylinder 4. Thereafter, the intermediate stack 1.1, whose sheets lie with their printed surfaces facing up, is moved by means of the linear conveying device 8, toward the right as seen in FIG. 1 into the sheet feeder 1, and is automatically lifted by means of a known feeder raising device to the working level of the feed table 1.2 and the sheet feeder 3. The press, with all printing functions, is automatically turned on, and printing of the reverse side, i.e. perfecting printing starts up and continues to the completion of the printing of a preselected number of printed sheets. The sheets 1.3 from the intermediate stack 1.1 are conveyed, arranged in the manner of scales, to the sheet feeder 3. In the process, the exact register of the printing on the front and back, as well as toward the front and lateral edges of the sheets is achieved, for example, by means of the alignment of the customary front, 2.1, and pull type lateral lay marks 2.2, respectively prior to the start of sheet feeding for each passage through the press.

Figure 2:
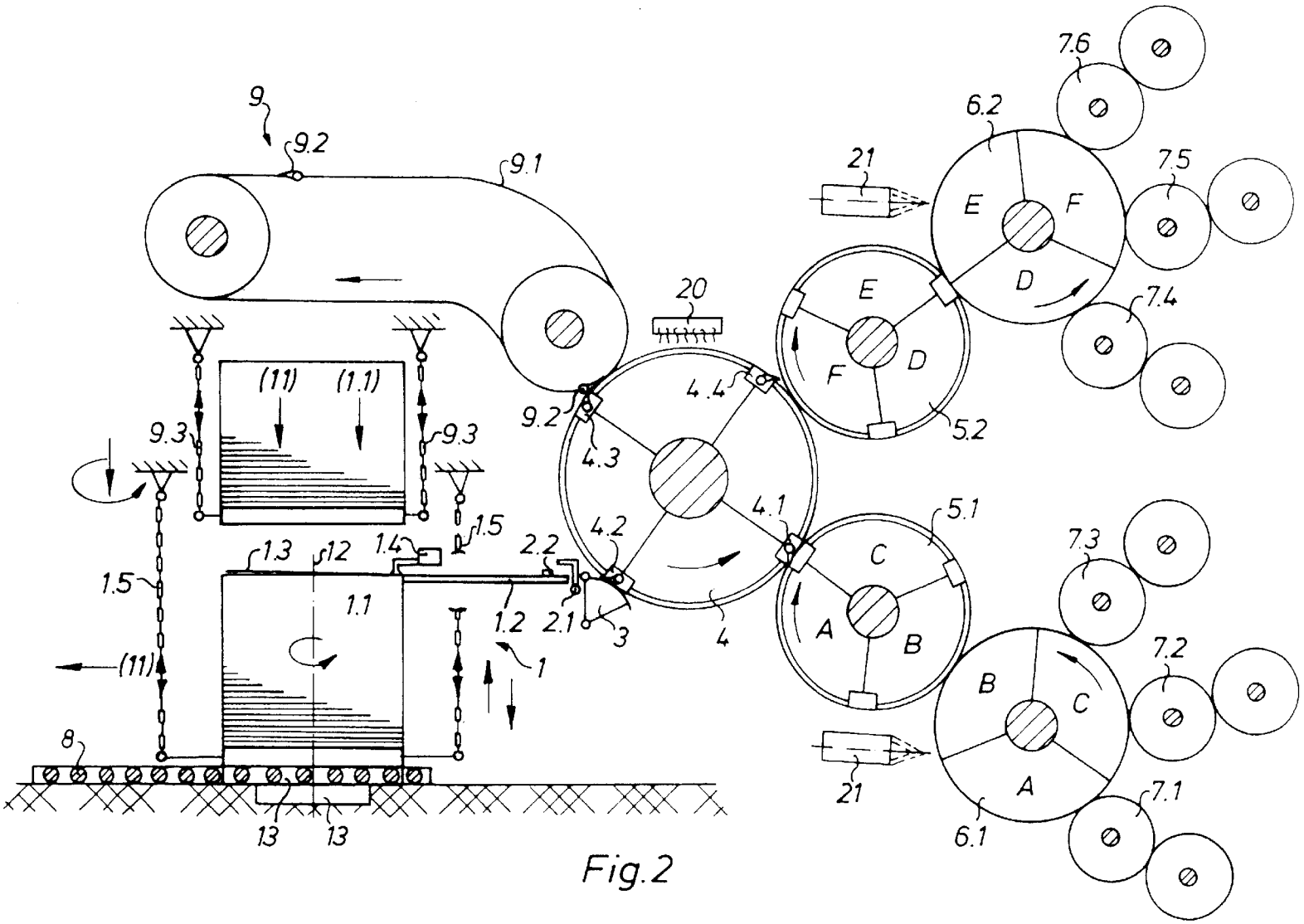

FIG. 2 shows a second preferred embodiment in accordance with the invention in connection with a six-color press. As was the situation with the press represented in FIG. 1, in the press shown in FIG. 2 the end stack 11 (=end storage device 11), the intermediate stack 1.1 (intermediate storage device 1.1) and the sheet feeder 3 are located on the bottom left with respect to the printing cylinder 4. The sheets can be transferred easily from the feed table 1.2 into the, for example, at least four—controlled gripper systems 4.1 to 4.4 of the printing and sheet feeding cylinder 4 by the sheet feeder 3 which may be, for example, a swinging gripper—. The end stack 11 lies above the upper level of the intermediate stack 1.1 and can be removed from the press. The stack 11 also can, for example, following the removal of the feed stack 1.1, or respectively the intermediate stack 1.1, be lowered down onto a turntable 13. The latter is easily possible in case of front edge sheet separation from the stack in the sheet feeder 1, as seen in FIG. 2. with rear edge separation of the sheet as seen FIG. 1 the sheet separator such as a section head 1.4 is moved away, for example laterally. The printing cylinder 4 supports four gripper systems 4.1 to 4.4, for example, and has four printing fields 4.1 to 4.4, which operate together with respectively three printing fields A, B, C, or respectively D, E, F, of two rubber blanket cylinders 5.1, 5.2 and two plate cylinders 6.1, 6.2. Three clock-regulated or time-controlled application rollers 7.1, 7.2, 7.3, or 7.4, 7.5, 7.6 of the respective three ink ducts 7 are assigned to each plate cylinder 6.1, 6.2. These each ink only one of the three ink color plate segments A, B, C, or respectively D, E, F, of the plate cylinders 6.1, 6.2. Laser guns 21 provide the ink color plate illustration in the press. Before it is removed by a gripper system 9.2 of a delivery chain 9.1, each sheet passes by the two rubber blanket cylinders 5.1, 5.2 three times. Because of the cylinder ratio of 4:3 between the printing cylinder 4 and the rubber blanket cylinder 5.1, 5.2, each sheet comes into contact with a different rubber blanket cylinder during each revolution. A double collection effect with respectively three different colors A, B, C; D, E, F occurs in the two print locations, so that a six-color print is produced for each plate cylinder revolution. Lying on the printing cylinder, for example, the sheets pass through a drying section of a dryer 20, for example a UV dryer and, after the sheets have been passed out of the gripper systems 9.2 of the delivery chains 9, they form the delivery stack 11 (=end storage device) with ink colors which are smear- and scratch-resistant or which are hardened. Upon reaching a previously set end of delivery, or when the delivery stack 11 is full, the press stops automatically. The delivery stack 11 is lowered and is moved out of the press toward the left past the turntable 13 by a linear conveying device 8.

The intermediate storage device 1.1 (=intermediate stack 1.1) is lowered onto the turntable 13 and rests thereon. The lowered intermediate stack 1.1 is then automatically pivoted by 180° in the plane determined by its sheets, and of course along with the sheets, so that now the rear edges of the sheets become the front edges of the sheets and the sheets point in the direction toward the print cylinder 4. The turntable 13 can also be installed in the delivery stack board or the feed stack board. Now the intermediate stack 1.1 is automatically lifted as the "feed stack" into the operational position of the sheet front edge separator 1.4, and the second passage of the sheets from the "former" intermediate stack 1.1 through the press is started for accomplishing perfecting printing. In the case of six-color printing on both sides, it is possible to omit the front and lateral lay marks, and therefore an actual feed table, when the guides of the lateral edges of the stack are set closely. In case of a demand for higher quality, the arrangement in FIG. 1, for example, with a rear edge separator 1.4 and with feed table 1.2, including the front and lateral lay mark orientation device 2.1, 2.2, can be used.

FIG. 3 shows the interaction of the sheet feeding to four print fields 4.1 to 4.4 and gripper systems 4.1 to 4.4 of the printing cylinder 4 with respectively three ink color surfaces A, B, C and D, E, F on rubber blanket cylinders 5.1 and 5.2 in connection with six-color printing by utilization of a press in accordance with FIG. 2.

The rubber blanket cylinders 5.1, 5.2, and the plate cylinders 6.1 determine the rhythm. For each plate cylinder revolution, respectively one sheet is fed at field A with D, and at field C with F one sheet is removed from the printing cylinder 4 by the gripper systems 9.2 of the delivery chain 9.1. Because of the ratio 3:4 between the diameter of the rubber blanket cylinders 5.1, 5.2 with respect to the printing cylinder 4, the sheet sequence to the grippers 4.1 to 4.4 does change, but the ink color sequence remains constant and does not change. Moreover, each sheet is maintained—for almost three revolutions—in its initial gripper system 4.1 to 4.4 without a gripper change, until all six colors A, B, C; D, E, F have been printed. At the start, and at the end of printing respectively, two sheets of waste are generated, on which two, or respectively four, colors are missing and which can be automatically deposited in a waste outlet, not represented.

The invention is not limited to the described preferred embodiments. For example, rubber blanket and plate cylinders of so-called double diameter for two colors can be arranged one behind the other around printing cylinders, with a single color collecting effect. For multi-color printing, four or more color fields can lie one behind the other. In place of the short inking systems, it is possible to employ normal vibrator or film ink systems. For wet offset printing, damping systems of known construction, or ink-water emulsion inks, can be employed. The rubber blanket cylinders 5 can be omitted, and the plate cylinders can print directly from flexographic printing plates against the printing cylinder 4. In that case, six-color flexographic print on one side is achieved with only three cylinders analogously to FIG. 2 in one operating cycle, and six-color flexographic prime and perfecting printing in two automatic operating cycles.

The printing plates can be illustrated, exactly registered, in the press by means of laser guns 21 or the like, or outside of it by customary means, including exactly registered plate fixing.

While preferred embodiments of methods for printing sheets in accordance with the present invention have been set forth fully and completely hereinabove, it will be apparent to one of skill in the art that changes in, for example the drives for the cylinders, the types of gripper systems used, and the like can be made without departing from the true spirit and scope of the present invention what is accordingly to be limited only by the following claims.

What is claimed is:

1. A method for prime and perfecting printing of sheets in a sheet-fed rotary printing press including:

providing a feed stack of sheets;

passing sheets from said feed stack of sheets in a first printing passage through a printing press;

printing a first side of each of said sheets during said first printing passage with a prime print subject and with a perfecting print subject located next to it;

providing an intermediate sheet storage device;

delivering said sheets printed during said first printing passage through said printing press to said intermediate sheet storage device;

placing said sheets printed during said first printing passage on said intermediate said storage device with a first printed side facing up and with leading sheet edges facing away from a printing cylinder of said printing press;

temporarily storing said sheets printed in said first printing passage in said intermediate sheet storage device;

rotating said temporarily stored sheets through 180° in a plane defined by said temporarily stored sheets;

pressing said sheets from said immediately stored sheets in a second printing passage with said printed first sides contacting said printing cylinder and with said leading sheet edges facing said printing cylinder;

printing a second side of each of said sheets during said second printing passage with said prime print subject and said perfecting print subject located next to it;

providing a process control and using said process control for checking the fully automatic printing process during said first and second printing passages through said printing press having one printing forme for said prime printing and said perfecting printing;

providing a sheet delivery device and delivering said sheets printed on both said first and second sides to said sheet delivery device; and providing an end storage device and delivering said sheets printed in said prime and said perfecting print to said end storage device.

2. The method of claim 1 further including providing a printed sheet dryer and passing said sheets, after at least one of said first printing passage, said delivery to said intermediate sheet storage device, and said second printing passage, and prior to said delivery to said sheet delivery device and said end storage device, through said printer sheet dryer.

* * * * *

UNITED STATES PATENT AND TRADEMARK OFFICE

CERTIFICATE OF CORRECTION

PATENT NO. : 6,293,193 B1
DATED : September 25, 2001
INVENTOR(S) : Hans-Bernhard Bolza-Schunemann It is certified that error appears in the above-identified patent and that said Letters Patent is hereby corrected as shown below:

Column 6,
Line 62, after "intermediate" change "said" to -- sheet --;

Column 7,
Line 3, before "said sheets" change "pressing" to -- passing --, and before "stored" change "immediately" to -- intermediately --

Signed and Sealed this

Twenty-third Day of April, 2002

*Attest:*

*Attesting Officer*

JAMES E. ROGAN
*Director of the United States Patent and Trademark Office*